US005100153A

United States Patent [19]

Welte

[11] Patent Number: 5,100,153

[45] Date of Patent: Mar. 31, 1992

[54] GAME USING RADIO-CONTROLLED VEHICLES

[76] Inventor: Gregory A. Welte, 406 E. Clark St., Apt. 3, Champaign, (Champaign County), Ill. 61820

[21] Appl. No.: 482,035

[22] Filed: Feb. 20, 1990

[51] Int. Cl.[5] ..... A63H 17/045; F41J 9/02

[52] U.S. Cl. ..... 273/357; 124/29; 273/355; 273/359; 446/88; 446/191

[58] Field of Search ..... 273/357, 355, 356, 359; 446/454, 455, 456, 435; 124/29

[56] References Cited

U.S. PATENT DOCUMENTS

| | | | |
|---|---|---|---|
| 2,474,054 | 6/1949 | Jones | 124/29 |
| 2,775,848 | 1/1957 | Isaacson | 446/436 |
| 3,065,569 | 11/1962 | Nielsen et al. | 446/88 |
| 3,103,762 | 9/1963 | Glass et al. | 446/191 |
| 3,811,675 | 5/1974 | Torgow | 273/357 |
| 4,938,483 | 7/1990 | Yavetz | 273/311 |

FOREIGN PATENT DOCUMENTS 3008604 3/1980 Fed. Rep. of Germany .

OTHER PUBLICATIONS

Radio Shack 1990 Catalog 1-1990.
Fordham 1990 Catalog 1-1990.

*Primary Examiner*—William H. Grieb

[57] ABSTRACT

The invention relates to a game using remotely-controlled miniature vehicles. One player drives an invading vehicle which shoots a ping-pong ball at a target which is defended by a second player. The defender fires balls at the vehicle and, if he strikes the vehicle, the vehicle incurs a penalty of temporary disablement. In addition, the vehicle can be required to periodically tag bases which the defender strews on the playing field; failing to do inflicts a penalty. Further, the invader can fire two types of missiles, and the defender must protect two goals. Firing the first missile can act as a feint by which the defender is distracted from defending one of the goals.

17 Claims, 13 Drawing Sheets

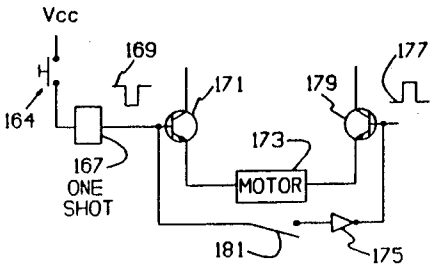
FIG 22
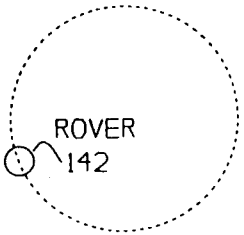
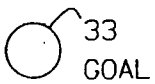
FIG 18
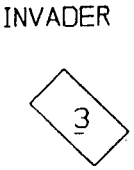
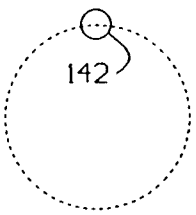
FIG 19
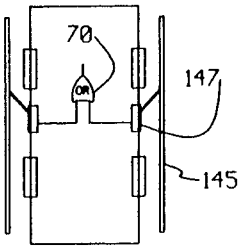
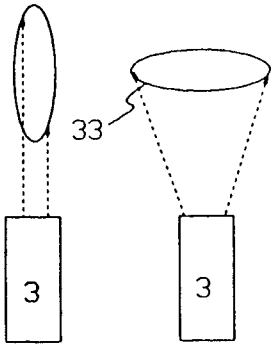
FIG 23
FIG 17A
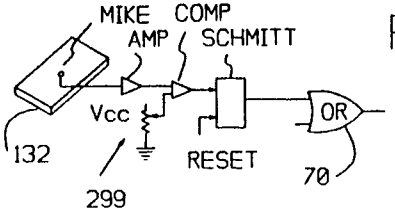
FIG 21
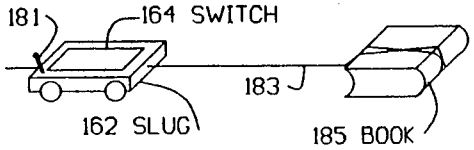
FIG 17
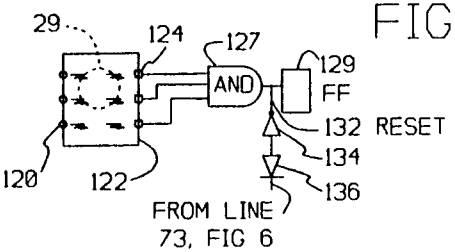
FIG 20
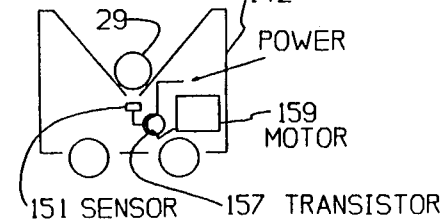

GAME USING RADIO-CONTROLLED VEHICLES

The invention concerns remotely controlled miniature vehicles which shoot a ball toward a goal, while being fired upon by a goal defender.

BACKGROUND OF THE INVENTION

Remotely controlled miniature vehicles are well known, and some have achieved a high degree of sophistication. For example, such vehicles can achieve very high speeds, and have suspension systems and knobby tires which allow them to drive outdoors on dirt or cinder tracks.

Vehicles of this type offer friendly competition between players. They also present an entertaining challenge to hand-eye coordination.

OBJECTS OF THE INVENTION

It is an object of the invention to provide a game which involves remotely controlled vehicles.

SUMMARY OF THE INVENTION

In one form of the invention, a player has a radio-controlled vehicle which must successfully run a gauntlet in order to attain a position from which it can shoot a lightweight ball into the defender's goal. While running the gauntlet, the vehicle is bombarded by one or more weapons, such as balls or light beams, shot by the defender. When the vehicle is struck, it suffers the penalty of temporary disablement.

In another form of the invention, the defender has a low-slung vehicle which automatically creeps, slug-fashion, toward a goal. The invader can temporarily stop the march of the slug, or briefly reverse the march, by running over it. If the slug reaches the goal before the invader knocks out all the defender's targets, the defender wins the round.

In another form of the invention, the defender has two goals, and the invader carries another weapon in addition to the ball. The second weapon is a heavy ball, or a self propelled vehicle, which the invading vehicle propels along the ground toward one of the goals. This attack distracts the defender, allowing the invader to more easily attack the second goal.

BRIEF DESCRIPTION OF THE DRAWINGS

FIG. 17 illustrates an apparatus for optically detecting a strike by a PING-PONG ball.

FIG. 17A illustrates an apparatus for acoustically sensing a strike by a PING-PONG ball.

FIG. 18 illustrates the operation of rover vehicles 142 which induce penalties in the invading vehicle 3 if the former strike the latter.

FIG. 19 illustrates touch sensors which sense contact of the rover vehicles.

FIG. 20 illustrates an apparatus for disabling a rover vehicle in response to capture of a PING-PONG ball.

FIG. 21 illustrates a slug vehicle, which temporarily reverses direction when the invading vehicle (not shown) rolls over switch 164.

FIG. 22 illustrates a circuit for terminating power to, and reversing direction of, the slug vehicle in FIG. 21.

FIG. 23 illustrates the use of an oval goal 33 which accommodates different errors in shooting the PING-PONG ball, depending on the shooter's orientation.

DETAILED DESCRIPTION OF THE INVENTION

General Description

A player has a radio-controlled vehicle which tries to attain a position from which it can shoot a ball into a defender's goal, or knock down the defender's targets. While attacking, the vehicle is bombarded by one or more weapons, such as balls or light beams, shot by the defender. When the vehicle is struck, it suffers temporary disablement.

The defender has several defensive weapons. First, the defender has mines 21 in FIGS. 1 and 2 which temporarily disable the attacking vehicle, inflicting a performance penalty. Several different types of performance penalty are possible: (1) the vehicle may be forced to drive in circles uncontrollably; (2) the power supply to the vehicle can be periodically interrupted, so that vehicle motion becomes erratic and hard to control; (3) the vehicle can be forced to stop dead; (4) the vehicle can be forced to continue to drive at high speed, perhaps in a randomly selected direction, thus driving to an undesirable shooting position; (5) the vehicle can be forced to prematurely shoot the ball; or (6) any combination of the preceding. In general, the performance penalty impedes progress in scoring goals.

A second defensive weapon is an infrared light gun 23. The gun defines a line 24 which the vehicle cannot cross: the gun protects territory. If the vehicle crosses the line, a sensor (later described) on the vehicle triggers a performance penalty, similar to those described above. The gun may fire at intervals, as indicated in FIGS. 1 and 2, allowing the vehicle to dash across the firing line when the gun is not firing.

Figure 1:
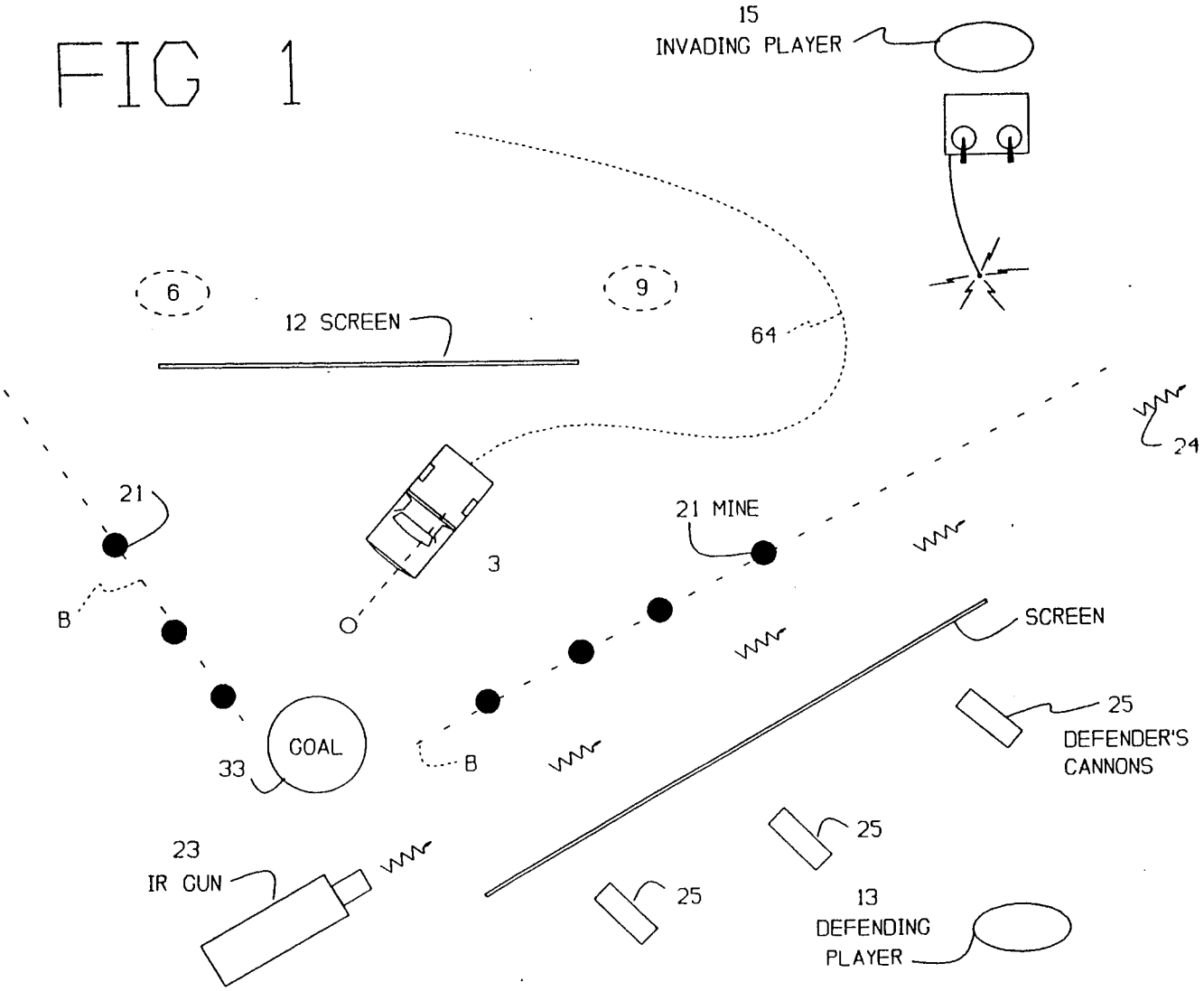
FIGS. 1 and 2 illustrate views of the invention in action.
Figure 2:
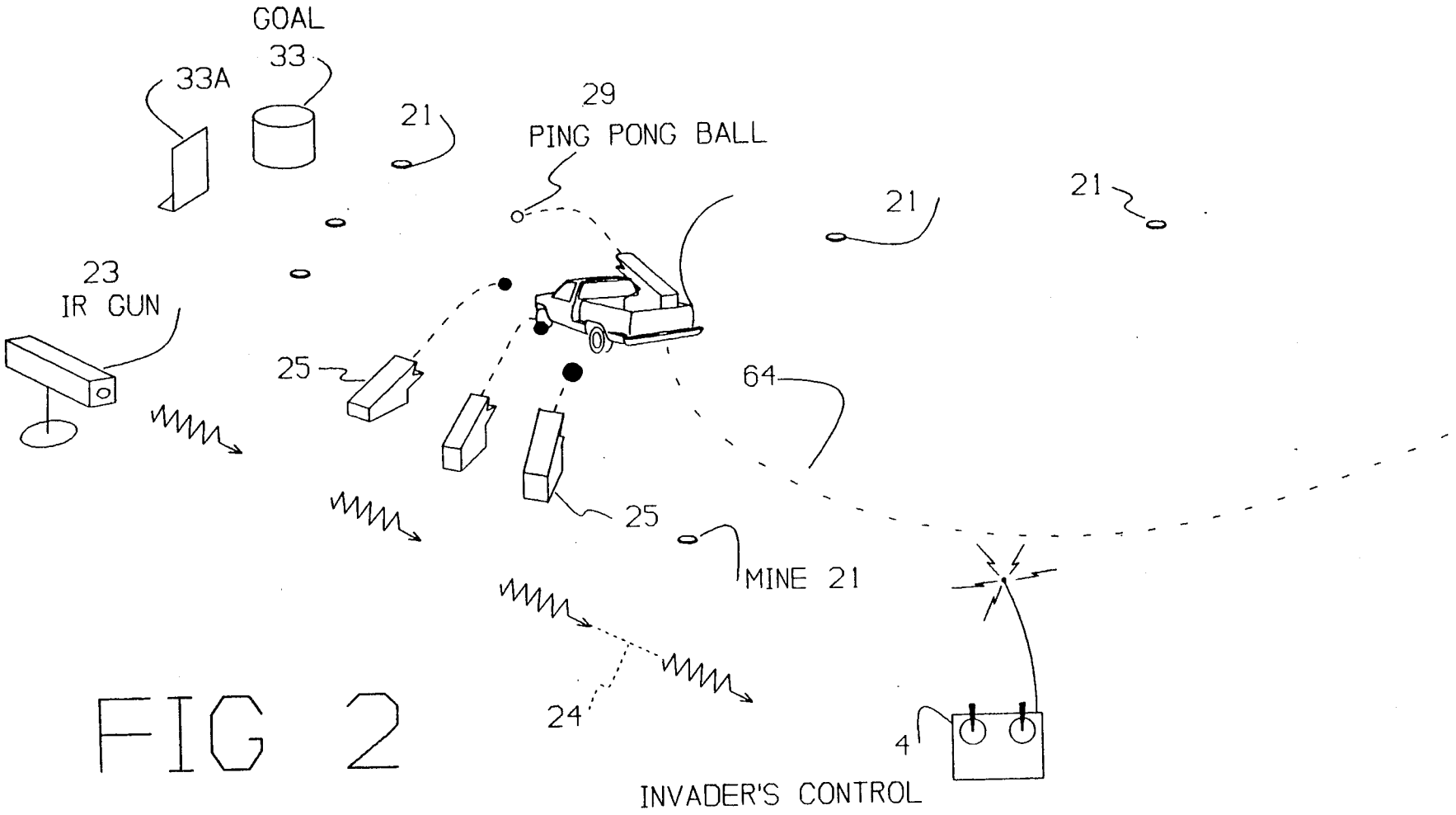

A third defense lies in stationary cannons 25 in FIGS. 1 and 2, like the ones on the vehicles. The vehicle 3 has a target (later described) which detects ball strikes, and triggers a performance penalty in response. It may be desired to manually toss the PING-PONG balls, or to use hand-held guns.

Screens can be provided behind which the invading vehicle can hide. The defender can also have screens behind which he can hide his weapons, so that the invader does not know where the weapons are aiming. The screens provide surprise and also allow for bluff play.

For example, in FIG. 1, the invading vehicle 3 can maneuver toward either position 6 or 9 if he is behind screen 12, without being seen by the defending player 13. The defender 13 must speculate as to where the invading vehicle 3 will pop up. Similarly, the invading player 15 cannot see where the defender's cannons are aiming. The defender can bluff by refraining from firing his weapons when the invader pops up, thus tricking the invader into believing that a given position is unprotected.

The purpose of the game is to score as many points as possible, while trying to inflict as many penalty periods on the opponent as possible.

In one variation, the invading vehicle does not try to avoid mines, as above, but, instead, he is required to run over a mine periodically in order to avoid a penalty. In this variation, the defender exercises some control over the invader's movements.

In another variation, independent roving vehicles travel about the playing field. A collision between the invading vehicle and a rover causes a penalty.

In another variation, the invading vehicle is microprocessor controlled.

More Detailed Description

Figure 3:
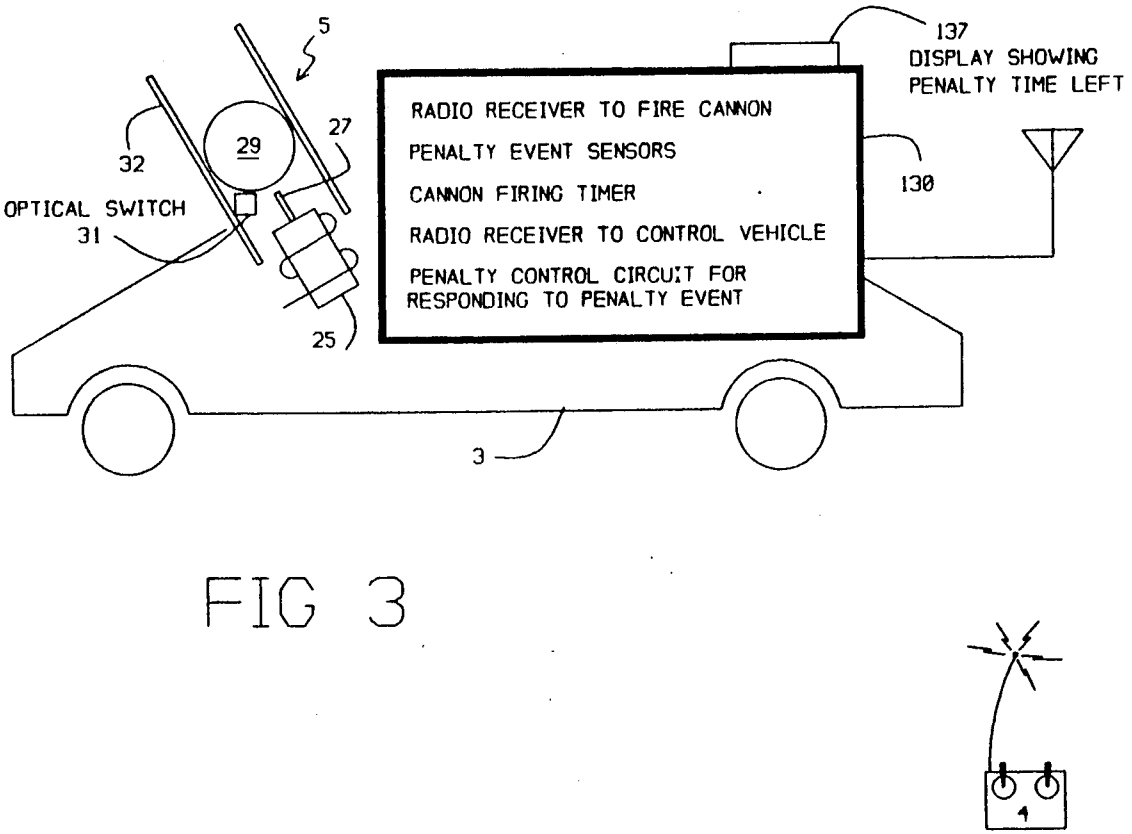
FIG. 3 is a schematic view of the invading vehicle 3.

FIG. 3 shows a radio-controlled vehicle 3, controlled by a radio control 4, which carries a cannon 5 in the form of a solenoid 25 whose plunger 27 strikes a PING-PONG ball 29 supported by a cradle 32. Applicant has successfully used a solenoid from a doorbell manufactured by the NuTone Corporation, Cincinnati, Ohio, and powered by three six-volt batteries in series. During play, the invading player 15 in FIG. 1 attempts to shoot the ball 29 into a goal 33, such as a wastebasket about one foot high and eight inches in diameter. Alternately, the invader tries to knock down targets 33A.

To use the cannon, a player loads his ball, sets a timer (described later), and embarks on a scoring drive. The timer determines the moment of cannon firing. (A switch 31 in FIG. 3 in the cannon can sense the presence of the ball and set the timer, thus eliminating the timer-setting step, and thus speeding up the play action. One such switch is an optical proximity sensor, such as Omron Photomicrosensor Model No. EE-SB5V, Cat. No. E56-E3-2, available from Digi-Key Corporation, Thief River Falls, Minn.)

With a timed cannon, the player must ensure that the vehicle 3 is positioned properly at the instant of firing, while avoiding the defender's weapons during the drive to this position. It is believed that this pre-set firing time will create a more interesting game than allowing a player to fire at will. Further, the pre-set time eliminates the need for an added communication link from the player to his vehicle. However, to the contrary, some players may prefer to fire their cannons remotely, at times selected by them. It is known in the art how to use transmitter 4 in FIG. 3 to fire the cannon. For example, transmitter 4 can be of type FP-4FG, 4ch, available from Futaba Corporation of America, 555 West Victoria Street, Compton, Calif. The transmitter can activate one of the servo mechanisms which Futaba supplies. The servomechanism closes a switch (not shown) which triggers the solenoid which strikes the PING-PONG ball.

Timing Devices for Cannon

There are numerous timing devices for providing the time delay. For example, in FIG. 4, after the player loads his ball, he presses and releases switch 40. Upon release, capacitor 42 discharges through resistor 44, giving a voltage plot as shown in FIG. 4A. The capacitor 42 is connector to a comparator 46, such that when the capacitor's voltage falls below the comparator's reference voltage, on line 48, the comparator's output changes state, triggering a one-shot 50, which applies a brief voltage pulse 51 to a Darlington 52. The Darlington 52 supplies current to the cannon solenoid 25, thus firing the PING-PONG ball 29. At this time, the cannon can be re-loaded, and the firing sequence can be repeated. The timing interval is determined by the RC time constant.

Figure 4:
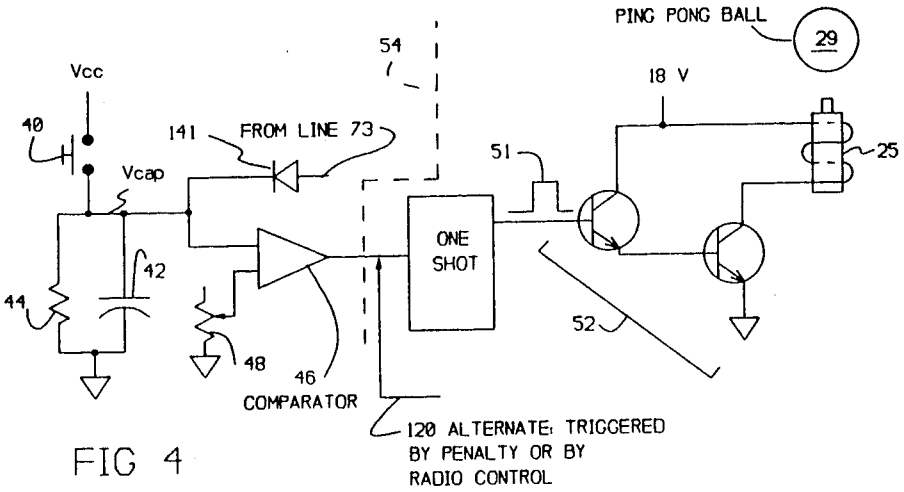
FIG. 4 illustrates a timer for firing the PING-PONG ball of FIG. 3 after an interval.
Figure 4A:
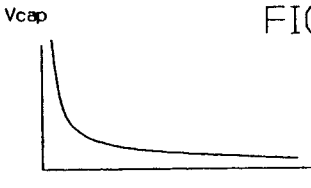
FIG. 4A illustrates the decaying voltage of the discharging capacitor of FIG. 4.
Figure 5:
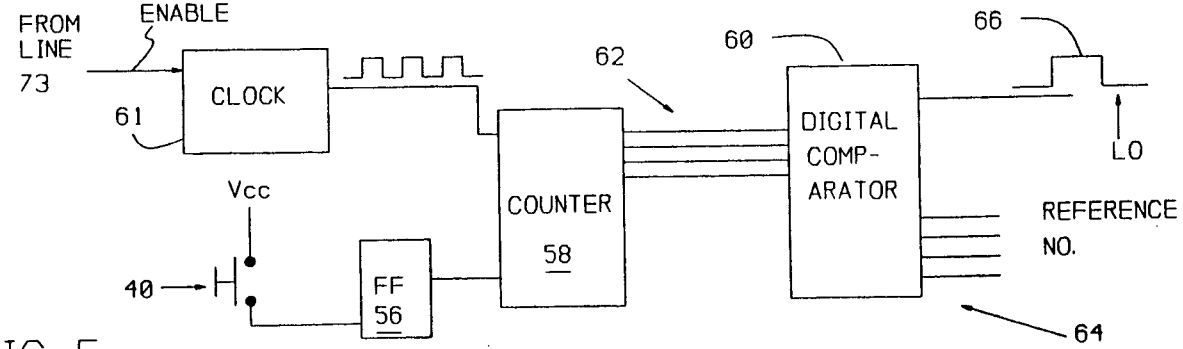
FIG. 5 is an alternate circuit for providing the time interval of FIG. 4.

Alternately, the components located to the left of dashed line 54 in FIG. 4 can be replaced by those in FIG. 5. The switch 40 flips flip-flop 56, which sets the enabling input of a counter 58, which starts counting. A digital comparator 60 compares the counter's output 62 with a reference binary number on bus 64, and when the former reaches the latter, provides an output signal 66 which triggers the Darlington 52 in FIG. 4. When the count provided by the counter 58 next changes, the output signal 66 will be driven LO, as indicated. The timing interval between the closure of switch 40 and firing is determined by the clock frequency, the number at which the counter 58 starts counting, and the binary number on line 64.

In addition, there are mechanical timing- and firing devices available as well, known in the art. For example, a rotary kitchen timer (not shown) can be easily adapted to trigger a cocked mechanism which fires the cannon. Also, if the vehicle is microprocessor-controlled, as described later, the timing involves simple programming stems.

Defender's Stationary Cannons

The defender's stationary cannons 25 in FIGS. 1 and 2 can be identical to those on the vehicle, with the exceptions that (a) each stationary cannon can be given a different time interval, (b) the stationary cannons are aimed independently, or (c) the stationary cannons can be activated at will by switches under the control of the defender. In the former two cases, the defensive player aims each cannon at a position where he predicts the vehicle will be located at the respective cannon's firing time. Then, as the offensive vehicle runs the gauntlet, along dashed line 64 in FIGS. 1 and 2, the cannons fire in sequence, striking the vehicle if they are properly aimed. Mines, and other obstacles, later discussed, can be positioned to require that the invading vehicle follow a fixed path, which may force the invader into a bottleneck, as shown in FIG. 1. (Lines B—B indicate the bottleneck, at which the invader has difficulty maneuvering.)

It is possible that the electrically fired cannons will provide a more interesting game than mechanical types, especially when, as stated above, a switch senses the loaded ball and automatically fires the cannon an interval later. One reason is that it is envisioned that an invading vehicle will sometimes successfully evade strikes by all stationary cannons, and then freely approach a good shooting position. At this moment, the defender would like to rapidly scoop up balls and reload his cannons. The loading and cocking of mechanical cannons would probably present an unacceptable time delay, while the all-electric cannons would be faster.

Penalty Circuit

Figure 6:
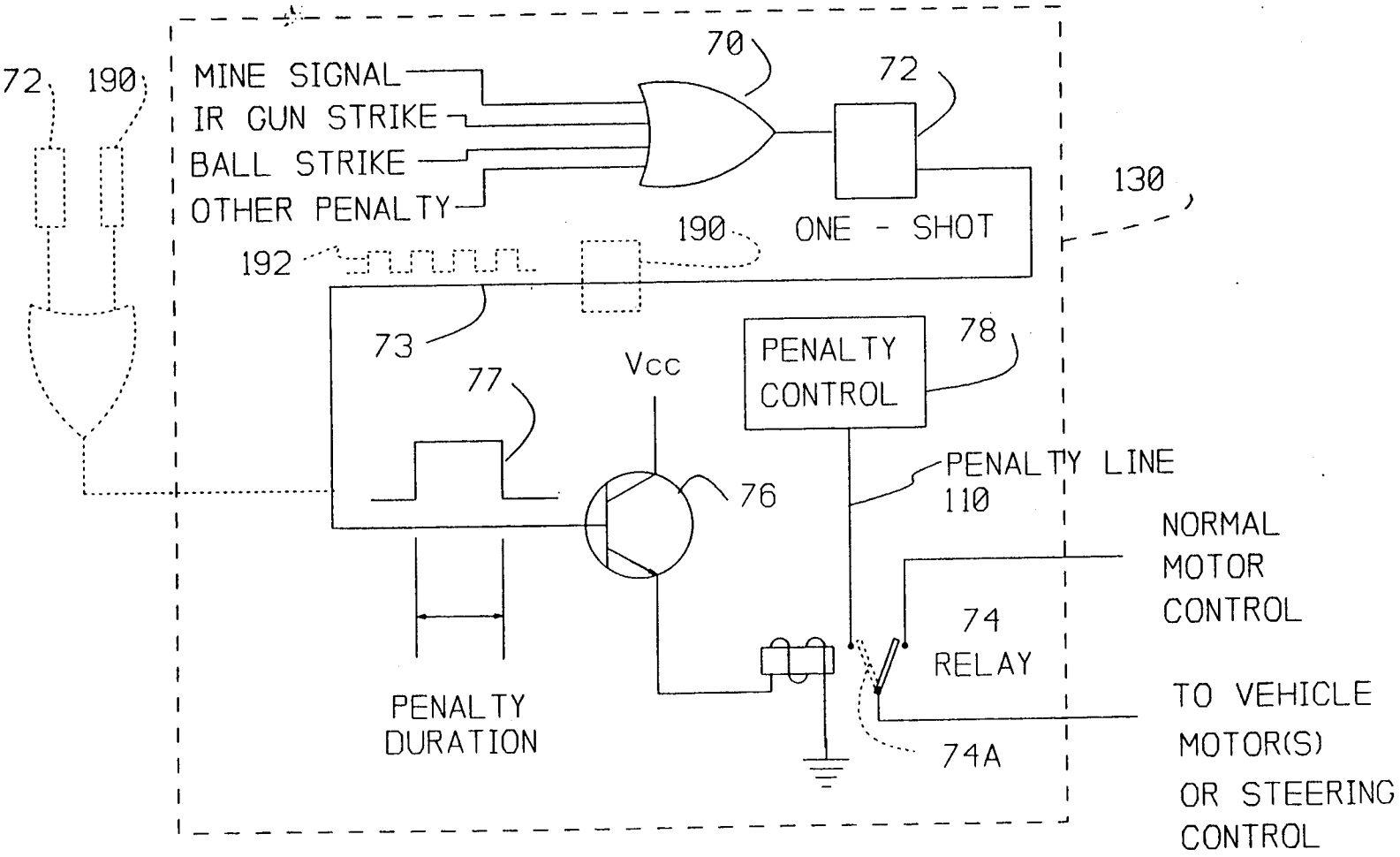
FIG. 6 illustrates an apparatus which can be retro-fitted to an existing miniature vehicle.

The several penalty-inducing events (eg, mine strikes, infrared cannon hits, and PING-PONG ball hits) each feed a signal to an OR gate 70 in FIG. 6. The output of the OR gate triggers a one-shot 72, which switches on a relay 74 by means of transistor 76. The one-shot 72 keeps the relay ON during the one-shot's pulse 77. The relay is biased such that, in the absence of applied current, normal operating control prevails. The pulse 77 may be viewed as a penalty flag.

The relay 74 disconnects the normal control system of the Vehicle's motors, such as propulsion motors and steering motors. The relay substitutes a penalty circuit for the normal control system, which assumes partial or full control of the vehicle for the penalty's duration. Several types of penalty circuit are later discussed, as are the particular penalty sensors on the vehicle.

Mines

In addition to cannons, each player has mines 21 in FIGS. 1 and 2 for penalizing the invading vehicles. The mines can be magnetic. One type of circuit for sensing when the vehicle 3 runs over the mines is shown in FIG. 7.

Figure 7:
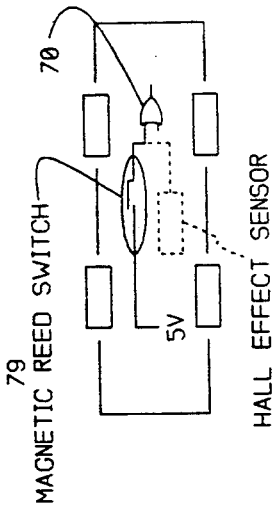
FIG. 7 illustrates sensors on the vehicle 3 for detecting mines.

To sense the mines, each vehicle 3 has a magnetically sensitive reed switch 79 which connects to the OR gate 70 in FIGS. 6 and 7. When the reed switch is closed by a mine, it produces a proximity signal which drives the OR output HI temporarily, giving control of the vehicle to the penalty control circuit, as discussed above.

Alternately, the mines can be shiny objects, such as sheets of aluminum foil or of corner cube reflectors, which are sensed by optical sensors on the invading vehicle, such as the sensors discussed above.

Infrared Light Gun

Figure 8:
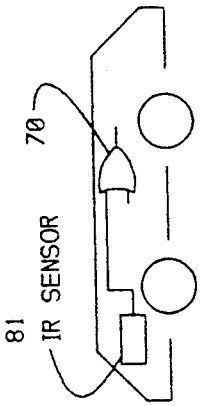
FIG. 8 illustrates a sensor on the vehicle 3 for detecting IR pulses.
Figure 8:
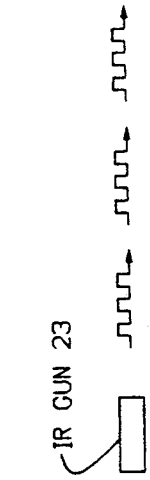

As another weapon, the defender has an infrared light gun 23 in FIGS. 1 and 2, which strikes an infrared detector on the vehicle, as shown in FIG. 8. Since ambient light contains infrared frequencies, it may be desirable to flash (or modulate) the cannon's light at a known frequency, and for the detector to respond only to such flashing frequencies, and not to ambient light. Such systems are commonly used in remote controls for televisions.

One modulation system is shown in FIG. 8. The receiver 81 is available as part number GPIU52X, catalog number 276-137, from Radio Shack ®, Tandy Corporation, Fort Worth, Tex. The transmitter, or IR gun 23, is essentially a 555 timer running at a frequency matched to that required by the receiver. Instructions for constructing such a transmitter-receiver pair are published by Tandy Corporation, and one such set of instructions is attached hereto as Table 1, and made a part hereof.

In general, firing the infrared cannon shoots a train of light pulses. The receiver is sensitive to the infrared light, but only when received as a train at a specified pulse frequency. Ambient, interfering infrared light is filtered out.

Sensing Strikes on Vehicle

Figure 9:
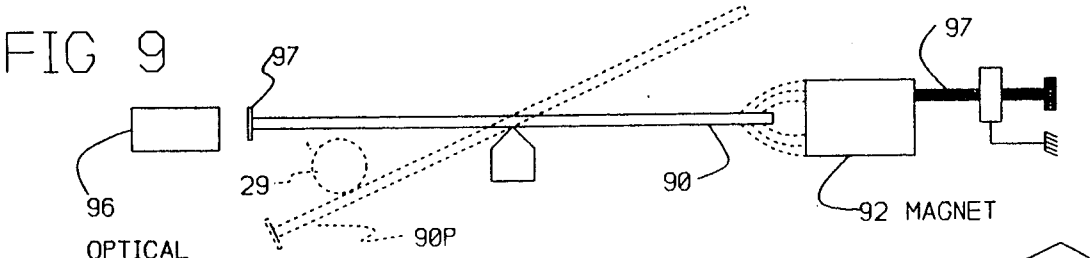
FIG. 9 illustrates a sensor on the vehicle for detecting a strike by a PING-PONG ball.
Figure 10:
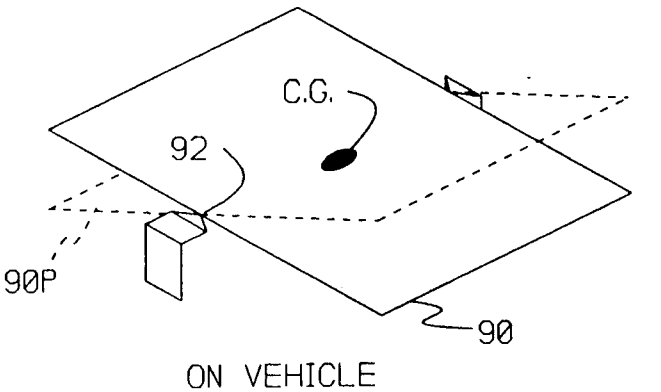
FIG. 10 illustrates one approach to mounting the flag 90 in FIG. 9.

For sensing strikes by the PING-PONG ball, each vehicle may be equipped with a strike sensor, as shown in FIG. 9. The sensor may be a mechanical flag 90 which produces perceptible displacement when struck by a PING-PONG ball 29: the ball 29 tilts the flag 90 to phantom position 90P. Preferably, the flag is supported at two pivot points 92 in FIG. 10, which define an an axis which passes through its center of gravity CG. With such a support, bouncing of the vehicle itself, which occurs as the vehicle moves, will not tend to trip the flag: the CG is driven up and down as bumps are experienced.

Figure 11:
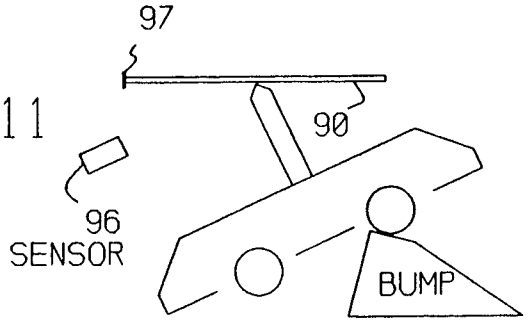
FIGS. 11 illustrates the fact that a change in pitch of the vehicle 3 can cause false triggering.

However, if the vehicle changes drastically in pitch, false indications of a ball strike may occur. As shown in FIG. 11, when the vehicle rolls over a bump, the flag, when pivoted as described above, will tend to remain in its previous orientation, as shown. The sensor senses displacement of the flag, and falsely indicates a ball strike.

Figure 12:
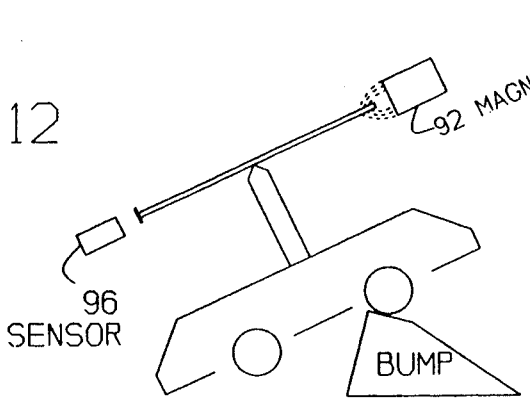
FIG. 12 illustrates how the magnet 92 in FIG. 9 prevents false triggering.

A magnet, shown in FIGS. 9 and 12, which is fastened to the vehicle and never contacts the flag, can gently bias the flag in position so that the flag follows changes in pitch, as shown in FIG. 12. With the magnet in FIG. 12, false indications are reduced.

The distance between the magnet and the flag 90 can be adjusted by screw 97 in FIG. 9, thus altering the holding power of the magnet and the sensitivity of the flag 90.

Flag-tripping can be sensed by the players themselves, or by optical proximity sensors of the kind described above, and leading to the OR gate, thus inflicting a performance penalty.

Figure 13:
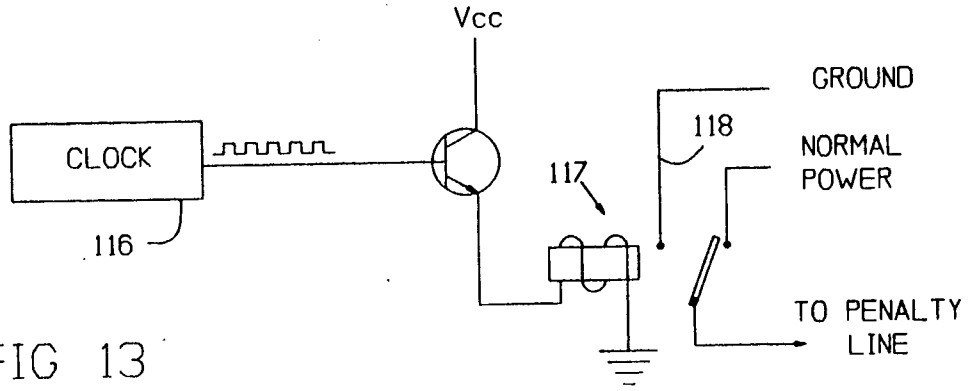
FIGS. 13 and 14 illustrate two types of penalty circuits 78 in FIG. 6.
Figure 13A:
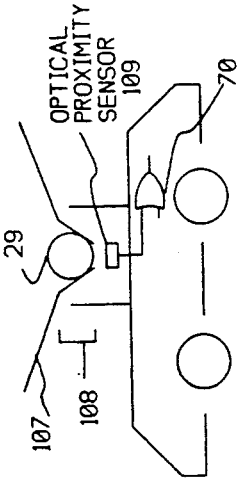
FIG. 13A illustrates a sensor for detecting the capture of a PING-PONG ball.

An alternate target may take the form of a basket 107 in FIG. 13A, which funnels a received ball down to its neck 108, where the presence of the ball is detected. The detection can be done by a mechanical switch, or optically. When a ball strike is detected, a penalty is imposed, as above, by a signal sent to the OR gate 70.

The basket need not take the form of a funnel, but may be a container on the vehicle, such as the bed of the pick-up truck 3 in FIGS. 1 and 2. Again, the ball's presence can be detected optically, by a broken light beam. It may be desirable to provide a resilient material, such as rubber foam, on the bed of the truck or in the funnel, in order to prevent the ball from bouncing out as it enters.

Another alternate is to position light sources 120 on one side of a hoop 122, as in FIG. 17, and photo sensors 124 on the other side. When a ball 29 passes through the hoop 122, one or more sensors will momentarily register a drop in received light. If the outputs are all ANDED together, in AND gate 127, a flip-flop 129 (or Schmitt trigger) connected to the AND gate will be tripped, causing the penalty. Termination of the penalty flag will re-set the flip-flop, by the signal on line 132. Invertor 134 inverts the signal, applying a HI signal when the penalty terminates. Diode 136 provides isolation.

Sensing the strike of the PING-PONG ball can be done acoustically. In FIG. 17A, a sheet of hard, transparent material, such as that used in making box-like picture frames, acts as a target 132. A common microphone, labeled MIKE, is glued to the target, and feeds an amplifier, AMP. The amplified signal is quite chaotic, since the target has no single resonant frequency. Nevertheless, when one or more signal components exceed the threshold defined by variable resistor 299, the comparator COMP triggers the Schmitt trigger, SCMMITT, which feeds a signal to OR gate 70.

Figure 17B:
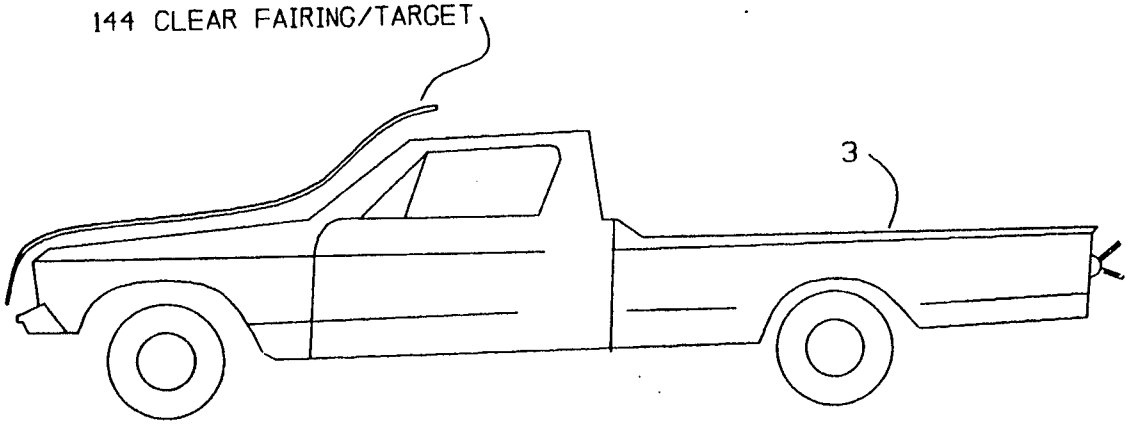
FIG. 17B illustrates a transparent fairing for a miniature vehicle which acts as the target 132 in FIG. 17A.

One advantage of using a transparent target is that it can be formed into the shape of a fairing 144 and attached to the hood of an existing vehicle, as in FIG. 17B. With this retro-fitting, the vehicle need not be redesigned, and the visual appeal of the original vehicle remains unaffected. Further, different targets of different size can be provided, and the user can interchange them in order to adjust the level of difficulty of the game.

Penalty Examples

First, the penalty circuit can simply terminate power to the motors for the penalty interval. In this case, the penalty line 110 in FIG. 6 leads to ground. (This configuration presumes dc motors are being used.) The vehicle is immobilized during the penalty period. During immobilization, to keep the player's interest, a signal on the vehicle can indicate the remaining duration of the penalty. For instance, a display 137 in FIG. 3 can exhibit the actual time remaining in the penalty.

It may be desirable to suspend the cannon timer in FIGS. 4 and 5 during this (or any other) penalty interval. Otherwise, the cannon (if fired by the elapse of a time interval) can fire during the penalty period, and the invader must return and re-load. This suspension can be accomplished by connecting the penalty flag 77 in FIG. 6 with an enabling pin of the cannon's clock in FIG. 5, thus suspending the count-down while the penalty flag is HI. (Of course, an invertor will be required if a LO signal is required to disable the clock.) Alternately, if a capacitor circuit is used, as in FIG. 4, the penalty flag 77 can hold the capacitor's voltage HI (as by a diode 141 connecting between flag 77 and the capacitor) until the penalty is over, at which time the capacitor begins to discharge in the usual manner. In this case, the penalty flag acts to reset the switch 40, starting the timing interval over. Alternately, if the cannon is remotely controlled, it may be desirable to allow the invader to fire the cannon at this time.

As a second penalty example, the penalty control system can invert the polarity of the voltage applied to the vehicle motor, thus causing the vehicle to run in the opposite directions expected. The invading player must compensate for this reversal in his driving. Similarly, the penalty circuit can apply opposite polarity to the steering motor, which causes opposite turns to those expected.

As a third example, the penalty control can be as shown in FIG. 13, wherein a clock constantly opens and closes a relay 117, which cycles the power supply to the vehicle's motor on and off. This power cycling will make the vehicle operate jerkily, when relay 74 in FIG. 6 connects to penalty line 110.

Figure 14:
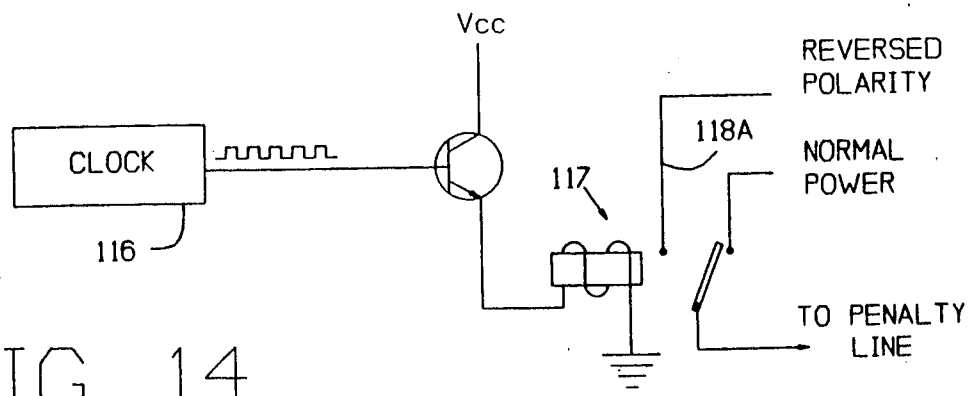

Alternately, line 118 can be connected to a reverse polarity power supply, as in FIG. 14, which will cause the vehicle to jerk forward and backward as the relay opens and closes.

As a fourth example, the penalty control 78 in FIG. 6 can affect the steering system of the vehicle. The penalty control can bias the steering to the left, for example, thus forcing the vehicle to run in circles. Alternately, the penalty control can alternately bias the steering left and then right, forcing the vehicle to "waddle," causing another type of loss of control.

As a fifth example, the penalty signal 77 in FIG. 6 can prematurely fire the cannon, causing a lost shot. Line 120 in FIG. 4 shows this.

Alternate Mine Detection

Instead of using reed switches, Hall effect sensors can be used to detect the mines. Such sensors have the advantage of being able to discriminate between different polarities of magnetism. For example, with a north pole of a magnet pointing upward, a given Hall effect sensor will produce a given voltage polarity (e.g., positive) when the vehicle is running east-to-west. The sensor will produce an opposite polarity (negative) when the vehicle reverses. (The voltage is determined by the equation $F=qv\times B$, wherein F is the force on an electron, q is the charge on one electron, v is the velocity of the electron, and B is the magnetic flux density. V is the sum of the drift velocity of the electron and the vehicle's speed. When the vehicle reverses, v can reverse in sign, thus inverting F.) The sensor will also produce the opposite polarity when crossing the south pole, when running in the west-to-east direction. These facts can produce several interesting variations, two of which are the following.

First, if the vehicle is sensitive to only one polarity, the mines can be rendered active or inactive merely by inverting them physically. (This can be advantageous if each player has a vehicle: his vehicle will not be sensitive to his own mines.) A defender can be equipped with several mines, only some of which he makes active. The inactive mines act as decoys, and the invader invader must detect the decoys by trial-and-error.

Second, a mine can trigger a penalty when the vehicle crosses in one direction, but not in the other direction. Thus, a given mine can be dangerous on a scoring drive, but not on a retreat.

An induction coil can also be used to detect magnetic mines. Also, the mines can be merely metallic. These can be detected by grid-dip meters, which are themselves used in many types of "metal detectors."

Figure 7A:
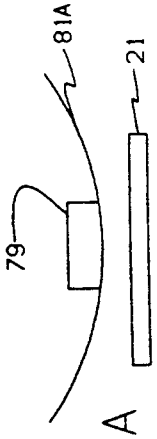
FIG. 7A is a cross-sectional view, taken from the side, of a shroud which allows the mine sensors to slide across a carpet without snagging.

The mine sensors can be protected by a hemispherical shroud 81A in FIG. 7A. This shroud will allow the sensors to be dragged along a carpet or through grass without snagging. It is desirable for the sensors to be brought as close as possible to the mines 21 for good detection, but carrying the sensors low to the ground can cause snagging.

Another Form of Invention

In another form of the invention, the invading vehicle 3 in FIG. 18 carries a cannon as described above. In addition, there are one or more roving vehicles 142. The rovers 42 run in circles, figure-eights, or randomly, and act as obstacles for the invading vehicle. The invading vehicle has touch sensors along its sides, which sense a collision with the roving vehicles. A collision causes a penalty. One type of collision sensor is shown in FIG. 19, wherein a bar 145 connects to a switch 147. Contact with the bar triggers the switch and prompts OR gate 70 to produce a signal.

The rovers 142 can be inactivated by a strike with a PING-PONG ball. One sensor for detecting a strike is like that shown above in FIG. 13, and is also shown in FIG. 20. A funnel 153 on the roving vehicle channels an incoming ball 29 to a neck, where an optical proximity sensor 151 detects the ball, and terminates power to the rover, as by turning off power transistor 157. Power to the motor 159 is thereby terminated.

If the rovers move randomly, then it is possible for them to move out of the zone of play. To prevent this, the playing field can be bounded by a barrier, such as a garden hose. The rovers cannot surmount the hose, but the wheels of the invading vehicle 3 are large enough so that it can do so. The invader is required to shoot from within the field, where he is subject to attack by the rovers. Of course, if the rovers run in circles, they will remain within a confined area, and the hose is not needed.

In addition, the defender has a low-slung, slow-moving vehicle 162 in FIG. 21 which he activates at the beginning of a round of play, and points toward a goal. This vehicle may be called a "slug," because of its slowness. If the slug reaches the goal before the invader has knocked down all targets, the defender wins the round.

The invader can temporarily stop the march of the slug by running over it, or "stomping" the slug. A circuit for causing the stoppage is shown in FIG. 22. Switch 164 triggers a one-shot 167, which turns off power transistor 171 for the duration of pulse 169. (A time delay may be desired so that the slug does not start moving until the invading vehicle rolls away, and is not then resting on the slug.)

Further, it may be desirable that a "stomp" causes the slug to retreat a distance, perhaps stop for a while, and then continue its march. This reversal can be accomplished by invertor 175 in FIG. 22. The pulse thus turns off power transistor 171, and simultaneously activates power transistor 179. However, the latter applies reverse current to the motor, thus driving the slug in reverse for the duration of pulse 169. With this feature, even if the slug is within an inch of the goal, the victor in a round is not necessarily known at that time. A switch 181 on the slug can select the type of operation, by merely disconnecting power transistor 179.

Moreover, it is well known how to briefly reverse a motor in response to a closure of switch 164 in FIG. 27.

Since repeated stompings can cause the slug to veer from its intended path, it may be desirable to guide the slug along a route. For example, a clothes line 183 in FIG. 21 can be fed through a tube in the slug, and tied between heavy books such as 185. The slug is required to follow the clothes line.

As to the size of the slug, the invading vehicle can have an axle height of about $1\frac{5}{8}$ inches. Applicant has experimented by driving such a vehicle over various books, and has found that books which are one inch thick present no significant obstacle. Books which are one and one-half inches thick (ie, which is nearly the distance from the axle to the ground) present a minor obstacle. Thus, the slug vehicle can be flat and no taller than the axle height of the vehicle.

Variations

1. The preceding discussion has assumed that the invading vehicle wants to avoid mines. However, it may be desired to require the vehicle to follow a path established by the mines: the invader must periodically "tag" mines, by getting sufficiently close to trigger its mine sensors. A simple inversion in the circuitry can accomplish the required operation. In the inversion, a different relay is used in place of relay 74 in FIG. 6. The new relay is biased such that the contact is normally in position 74A, when transistor 76 is off.

The player must keep the contact out of that position 74A by keeping the penalty flag 77 HI. That is, during normal operation, the contact is to be positioned as shown in solid outline, which connects to "NORMAL MOTOR CONTROL." If the player fails to tag a mine in time, the penalty flag falls LO and a penalty is imposed: the contact moves to phantom position 74A.

With no other changes to the circuit, the penalty will persist forever. In order to restore normal operation after a time interval, a clock 190 is ORed with the output of one-shot 72, as shown in phantom. Thus, if there is no output from the one shot 72, the clock will periodically drive line 73 HI and then LO: a penalty is imposed, and then normal operation occurs. To maintain normal operation, the one-shot must be triggered frequently enough that pulse 77 is maintained. A clock period of five to fifteen seconds is envisioned. Clearly, the relative durations of the respective clock and the one-shot pulses will affect the difficulty of the game, and these durations should be adjustable by the players.

For example, a long clock pulse and a long one-shot pulse will give the invader an advantage. A long clock pulse and a short one shot pulse will require frequent tagging, and cause a long penalty when a required tag is missed. Short clock pulses and short one shot pulses will requires frequent tagging, and a rapid dash to a mine to make a tag when a penalty for failure to tag terminates.

After a mine tag fails to occur when required, the contact in relay 74 is pulled to "NORMAL MOTOR CONTROL" the first time the clock 190 goes HI after penalty pulse 77 goes LO. An example will illustrate this operation.

If a player fails to tag a mine in time to re-trigger the one-shot 72, pulse 77 goes LO, the contact is pulled to position 74A, and a penalty is imposed. Without clock 190, and without an accidental HI output from OR gate 70 (as would occur if the penalty caused the vehicle to accidentally cross a mine), the penalty would persist forever. Clock 190 prevents this: clock 190 brings line 73 HI periodically, thus temporarily terminating the penalty and allowing the player to tag a mine. If the player fails to tag before the Clock goes LO, the cycle is repeated.

With the requirement of mine-tagging, the defender will, of course, place the mines as far as possible from the goal as possible. With this variation, inert mines become highly strategic: the invader does not know in advance whether a given mine will reset his clock, until he tries it for the first time. Also, the time display 137 in FIG. 3 becomes important: the invader wishes to know how much time he has before needing to run over a mine.

One shot 72 provides a pulse 77 in response to a trigger signal from OR gate 70. Further, if a trigger signal is received while the pulse 77 is HI, one pulse duration is added to the pulse at this time. Consequently, a sequence of triggers from OR gate 70, all spaced less than one "PENALTY DURATION" apart, keep the relay in the proper position. Numerous circuits can accomplish this.

2. An oval goal may be used. In this case, when the invader fires when facing the wide part of the oval, his left- and right aiming can be inaccurate, and still score a goal. Conversely, when the invader fires along the narrow axis, his left-right accuracy must be greater, but his distance can be less accurate. These features are illustrated in FIG. 23.

3. Cannon velocity, and thus distance fired, can be adjusted by adjusting the current passing through solenoid 25 in FIG. 4. This can be done by radio control, thus allowing a player to adjust his firing range while on a scoring drive.

Figure 23A:
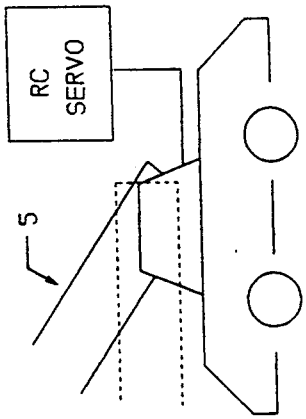
FIG. 23A illustrates that the cannon 5 is adjustable in inclination.
Figure 15:
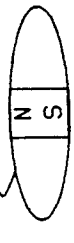
FIG. 15 illustrates a magnetic mine.

The cannon can be adjustable in inclination as shown in FIG. 23A, from horizontal to nearly vertical, and at all angles inbetween. The user can set the inclination in advance, or a radio-controlled servo, of the kind used to steer the invading vehicle, can be used, as shown. With radio-controlled inclination, the range of the cannon is under control, without adjusting the cannon's electric power.

Figure 16:
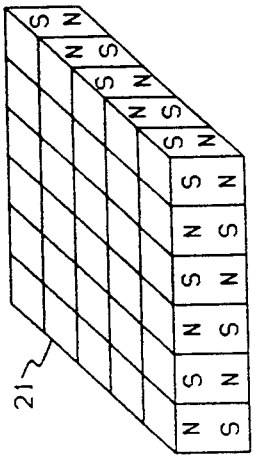
FIG. 16 illustrates a particular type of magnetic mine.

4. The magnetic mines can be of the sheet magnet type. These magnets comprise a plastic matrix, perhaps 1/16 inch thick, into which iron filings have been embedded. Then, the sheets are magnetized. It may be desirable to magnetize different regions of the mines with different polarities, in checkerboard fashion, as in FIG. 16. Then, when a vehicle crosses the mine, the sensor will detect the sequence of NSNSNSNSNSNS (ie, north, south, etc). Sometimes such a sequence is easier to detect using Hall effect sensors. However, magnetic mines are not essential, as a key feature is for the vehicle to detect the presence of a specific object.

5. The stationary cannons 25 in FIGS. 1 and 2 can be controlled by wires leading to switches for the defender to fire them: they need not fire at set intervals after loading.

6. It may be desirable to add weights to the balls, in order to trip the mechanical flags more solidly.

7. The IR gun 23 in FIGS. 1 and 2 can flash off and on, giving a vehicle a chance to dash past.

8. One form of the invention is an accessory for a pre-existing radio-controlled vehicle, as shown in FIG. 6. The accessory is indicated by dashed lines 130. The accessory is interconnected into the wires which normally control the motors or steering apparatus of the vehicle. With this accessory, re-design of an entire vehicle is not necessary. The accessory may fire the vehicle cannon on a self-timed basis, by including the circuits of FIGS. 4 or 5, or include a receiver which acts as a remote trigger as discussed above.

9. It is not necessary that radio control be used. Other types of remote control can be used, such as optical, or perhaps acoustical.

10. Several characteristics of PING-PONG balls are important. First, a flying PING-PONG ball continues to travel after it hits the ground: the ball can still roll to a target after landing. Similarly, a PING-PONG ball can be shot along the ground, as a golf putter shoots a golf ball. Other types of missiles, such as arrows or darts do not have these characteristics.

Second, PING-PONG balls are spherical; they are blunt. A strike from even a very fast PING-PONG ball will cause no injury. Such is not the case with elongated missiles.

Third, PING-PONG balls are very bouncy. This allows the ball to be shot by an impact. The shooting mechanism can be very compact. For example, the solenoid described above is only about 1.5 inches long by about one inch in diameter. In contrast, toy missiles do not have this bouncy characteristic: they are generally accelerated by a spring or by a gas discharge.

Fourth, the Inventor has measured a PING-PONG ball and found its shell to be about 0.015 inches thick and its diameter to be about 1.48 inches. A simple geometric computation shows that the volume of solid material in the shell is about 0.1 cubic inches (i.e., surface area $\times$ thickness, or $4 \times pi \times r^2 \times 0.015$), and the volume of the ball itself is about 1.69 cubic inches. The packing density is thus 0.1/1.69, or 0.059. This is the ratio of solid material to air. This particular density, together with a density up to five times as great (ie, 0.29) is defined as "substantially hollow." An expanded polyurethane foam ball can be substantially hollow. A golf ball is not substantially hollow.

Restated, a ball of the same size as a PING-PONG ball, but five times heavier, is considered "substantially hollow."

Fifth, PING-PONG balls are not designed for minimal aerodynamic drag for their mass. They have a constant frontal area, regardless of orientation: there is no minimal frontal area. In contrast, an arrow, or aircraft, is designed to be oriented to present a minimal frontal area to the incoming wind in order to reduce drag.

The balls are fired such that they fly about ten feet. The velocity acquired is probably less than that acquired by the balls in an actual game of PING-PONG. This velocity is sufficiently low that injury to persons or animals is precluded.

Figure 24A:
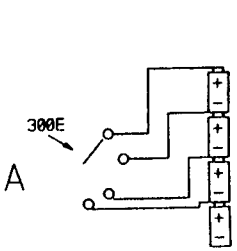
FIG. 24A illustrates selection of different currents for the cannon 5 in order to alter muzzle velocity.
Figure 24:
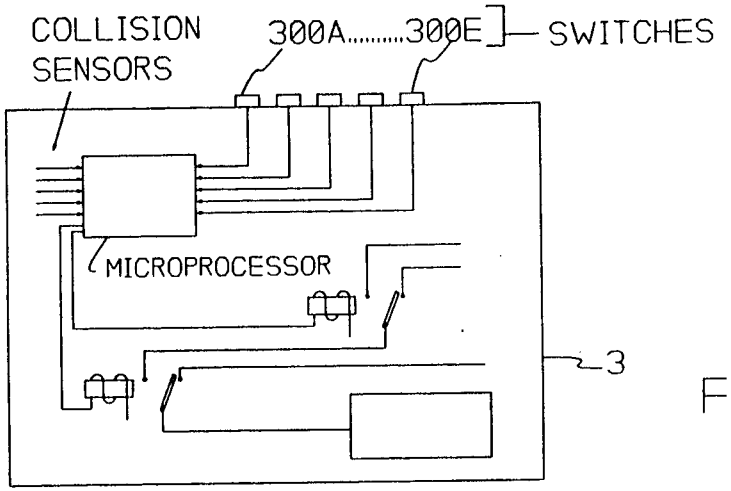
FIG. 24 illustrates a microprocessor on the invading vehicle 3 which can sense collisions and inflict penalties in response.

11. The invading vehicle can be microprocessor-controlled, which will provide great flexibility. The collision sensors, which detect collisions with rovers, encounters with mines, collisions with PING-PONG balls, and strikes with the IR gun, are fed to the I/O ports of the microprocessor, either directly, as shown in FIG. 24, or through the output of an OR gate such as OR gate 70 in FIG. 6. (In the latter case, the microprocessor cannot distinguish between types of collisions, since it only receives the OR gate output.)

Figure 25:
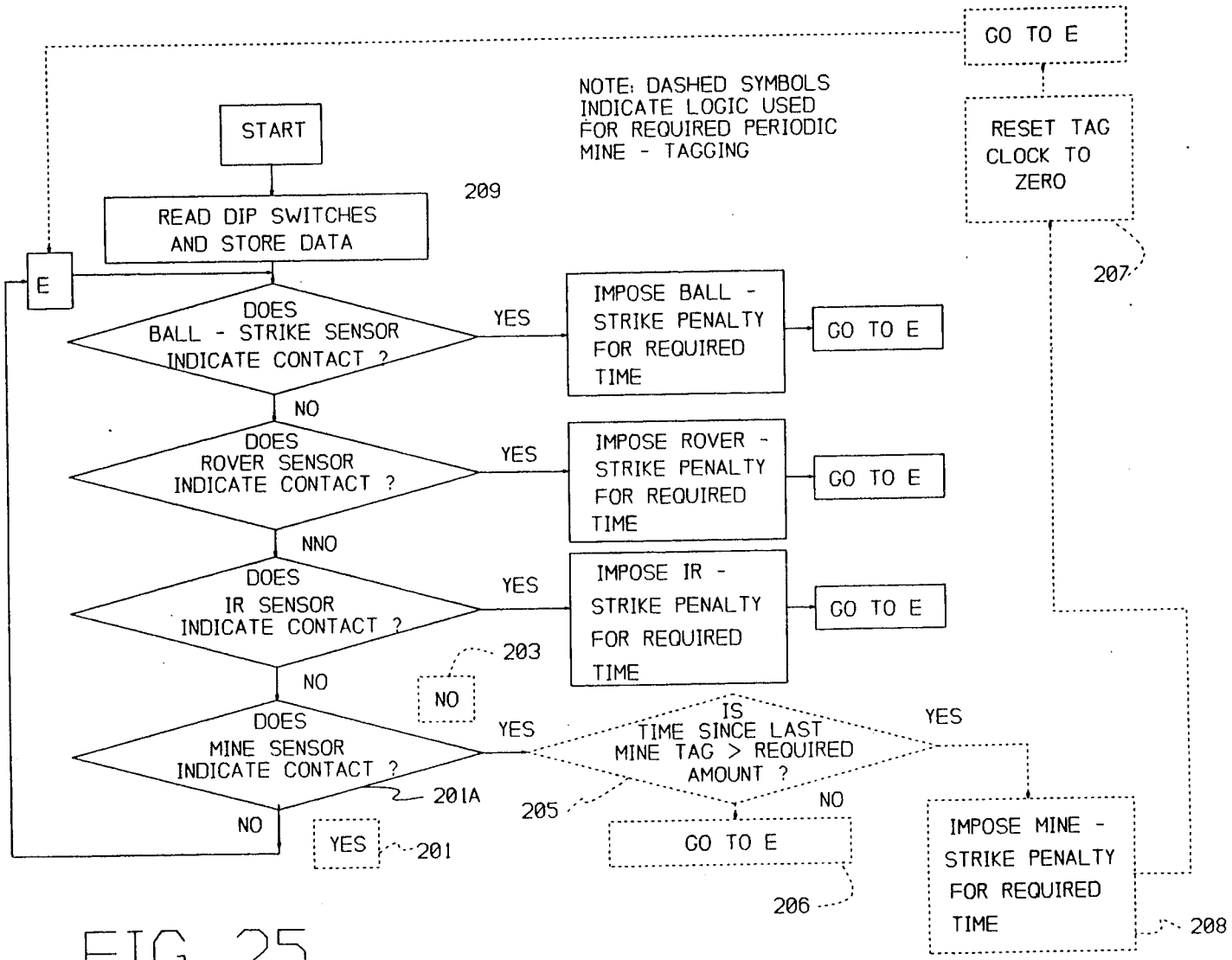
FIG. 25 is a flow chart illustrating one form of operation of the microprocessor of FIG. 24.
Figure 31:
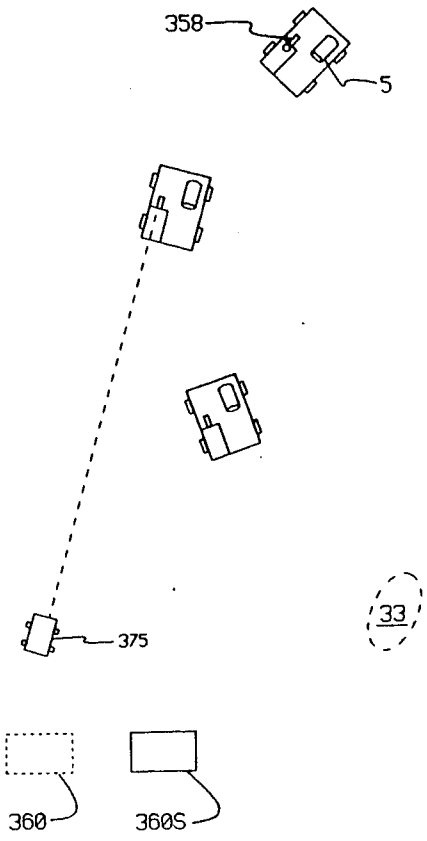
FIG. 31 illustrates a two-pronged attack in which the invader first launches a self-propelled vehicle 375.

One type of flow chart for programming the microprocessor is shown in FIG. 25. (The dashed boxes are discussed below.) In general, the microprocessor detects collisions and imposes the appropriate performance penalty in response. Different types of collision can cause different penalties, as the Figure indicates. Further, the penalty for a given type of collision can change. The change can be random, according to a sequence, or according to a sequence that is sufficiently complicated that it is effectively random.

For example, the penalties can be A, B, C, and D. A can refer to a dead stop; B can refer to running in circles, etc. The following eleven data can be stored in memory locations 100 through 110: A, A, C, B, D, B, C, D, A, B. When the first collision is detected, the microprocessor imposes the penalty at address 100; for the second collision, the penalty at address 101 is used, and so on. Thus, the panalties are selected from a predetermined sequence. If the sequence is sufficiently long, then the penalties are, in effect, randomly selected, since the sequence rarely repeats.

During normal operation, in which mine-tagging is not required, the steps shown in the dashed boxes 201, 203, 205, 206, and 207 are not taken: the program proceeds as though the dashed boxes were absent. During normal operation, the processor cycles through its program and, if no penalty-inducing events are detected, it simply starts over. If a penalty event is detected, such as a mine contact, a penalty is imposed for a time interval, and normal cycling is resumed.

If mine-tagging is required, then the mine-response step 201A is different. If a mine is detected, all is well, and dashed box 201 returns the logic to box E. However, if no mine is detected, then the negative in box 203 takes the logic to inquiry 205. In box 205, if the time since the last tag of a mine does not exceed the limit, then box 205 sends the logic to box 206, and the logic recycles from box E. However, if the time limit is exceeded (that is, the last tag of a mine was too far in the past), then a mine-type penalty is imposed by box 208. Then, box 207 re-sets the time clock within which a mine tag must next occur (because the penalty for failing to make a tag has just been paid) and the logic returns to box E. Now, when NO block 203 is next reached, the logic will go to box 206, since the measured time interval since the last mine tag has been reset.

The microprocessor allows the players to change the style of play. For example, switches 300A through 300E in FIG. 24 lead to the I/O of the microprocessor. Box 209 in FIG. 25 reads the switches. These switches can be 8-switch DIP's, which send an 8-bit word to the microprocessor. The eight-bit word allows 256 different messages to be sent. Switch 300A can send a word indicating how much time is allowed to the vehicle for making a shot with the PING-PONG ball. When the time is exceeded, the ball shoots automatically. Setting this switch is tantamount to setting the RC time constant in FIG. 4.

Switch 300B can select how long the performance penalty should last. Perhaps only four bits are needed for thias selection. 0000 can indicate 3 seconds, 0001 can indicate 6 seconds, etc.

Switch 300C can select which penalty is used. 0000 can indicate running in circles is the penalty; 0001 can indicate that high-speed running in the present direction is the penalty; 1111 can indicate that random penalties are selected; etc.

Switch 300D can activate and de-activate the responses to collisions. 0000 can indicate that all collisions cause penalties; 0001 can indicate that all collisions except those with magnetic mines cause penalties; 0011 can indicate that all collisions except those with mines and rovers cause penalties; 0100 can require mine-tagging; etc. (If mine-tagging is an option, other switches should be provided to set the period of clock 190 in FIG. 6, and the duration of flag 77, as discussed above.)

Switch 300E can select the voltage applied to the cannon's solenoid, thus changing the range of the cannon. This switch can be a rotary switch which merely selects different voltages supplied by several batteries in series, as shown in FIG. 24A.

Figure 26:
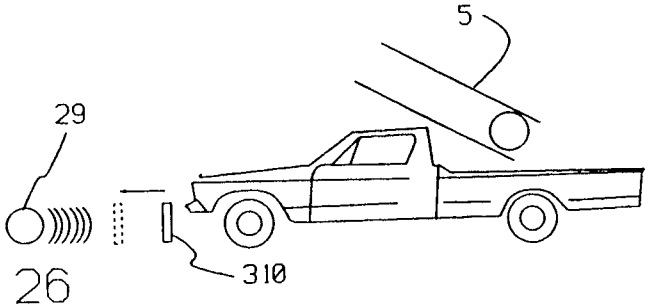
FIG. 26 illustrates a bumper 310 which kicks a PING-PONG ball along the ground.

12. It is not necessary that the PING-PONG cannon shoot the ball into the air. The cannon can act as a "putter" and knocks the ball along the ground, like a soccer player, toward targets standing on the ground, or toward a goal. For example, a bumper 310 on the vehicle, as in FIG. 26, is triggered by a solenoid (not shown) and knocks the ball along. With this feature, the vehicle can utilize the defender's balls which were fired at the vehicle, and left lying on the field, which adds risk to the defender's shooting.

13. The term "remote control" has been used. This term refers to control without wires or other mechanical attachment extending between the vehicle and the operator. This feature allows obstacles to occupy the path between the player and the vehicle. For example, the rovers will probably run between the player and his vehicle. A cable would interfere with the rovers. As another example, a cable would not allow the vehicle to travel behind a screen 12 in FIG. 1: the cable would probably knock down the screen. As a still further example, remote control devices can sent signals for five, ten, and twenty feet. Expensive devices have a range of 500 yards. Twenty feet of cable would be extremely cumbersome. More sophisticated remote control devices can transmit signals for one thousand feet.

Moreover, remote control, as described above, allows a single transmitter to control multiple servomechanisms at different locations. A single transmitter can control several PING-PONG cannons, a vehicle, the slug, etc. Running wires to each of these devices, even if the devices are not moving, is time-consuming in set-up and cumbersome in play.

Further, "remote control" implies approximately real-time control. Pre-programming of a vehicle is not considered remote control, although the microprocessor can be pre-programmed in certain respects, and yet the vehicle is remotely controllable.

Figure 27A:
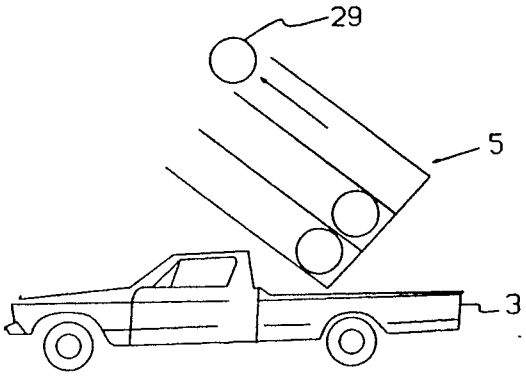
FIGS. 27A and 27B illustrate multiple cannons and a cannon bearing a magazine, respectively.
Figure 27B:
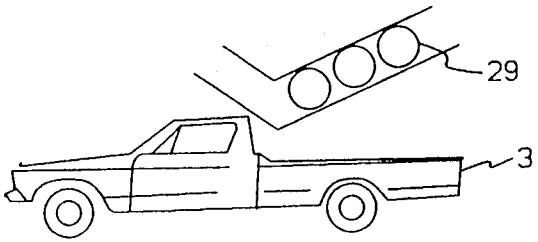

14. It may be desirable for the invading vehicle to carry several cannons, such as a battery of four or six, as shown in FIG. 27A. Alternately, a single cannon having a magazine holding several balls can be desirable, as shown in FIG. 27B. PING-PONG guns having magazines are known in the art. In the former case, all four or six cannons can be fired either simultaneously, or in sequence.

15. It is not necessary that the components described above be used in the manner described. For example, one type of play may lie in each player having a slug, which moves toward the other player's goal. The slugs respond to ball strikes and to rover strikes. Rovers randomly stall the slugs by running over them. Meanwhile, each player shoots balls across the playing field toward the other player's targets, and toward the rovers, trying to stop the rovers. When the first slug reaches a goal, points are awarded to the owner, and the award is modified by the relative difference in target strikes between the players.

As another example, a single invading vehicle can be used, having one cannon and a sensor which detects ball strikes. The invader tries to score a goal, while the defender manually throws balls at the invader, perhaps by using a PING-PONG paddle to strike the ball. When the vehicle is hit, it fires the ball, the opportunity to score is lost, and the defender wins the round.

As a further example, the invading vehicle 3 need not be remotely controlled, and the goal can be extremely large. The invader loads the cannon on the vehicle and sets the vehicle off toward the goal. The defender fires, or throws, PING-PONG balls at the incoming vehicle. If the defender scores a hit soon enough, the cannon will fall short of the goal. If not, the cannon will score a goal. Alternately, the sensor on the invading vehicle can trigger the cannon, but with a voltage different from the normal voltage. Thus, perhaps, when the defender strikes the invader, the cannon is forced to make a very weak shot.

16. It is not necessary that actual action be taken in response to sensed events. For example, as stated above, sensing of a ball strike on a vehicle causes the action of a performance penalty. Also, when the slug vehicle senses contact with the invader, it takes the action of stopping, or reversing. Instead, a signal can be produced, possibly causing a light to illiminate. The light indicates the sensing of the event, and allows a score to be tallied.

17. The goal toward which the slug vehicle advances can be placed in a zone where the invader is liable to be struck by the defender's ball cannons. This positioning will cause the invader to prefer to stomp the slug early in its progress, because at that time the invader will be out of range of cannon strikes.

Figure 28:
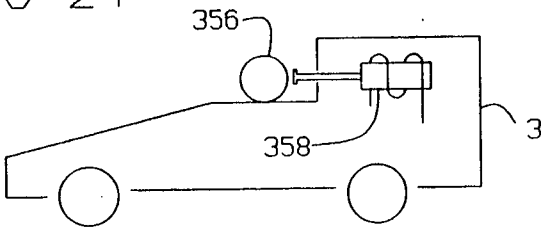
FIG. 28 illustrates an addition to the invading vehicle 3, namely, a solenoid 358 which can shoot a golf ball 356 along the ground.
Figure 30:
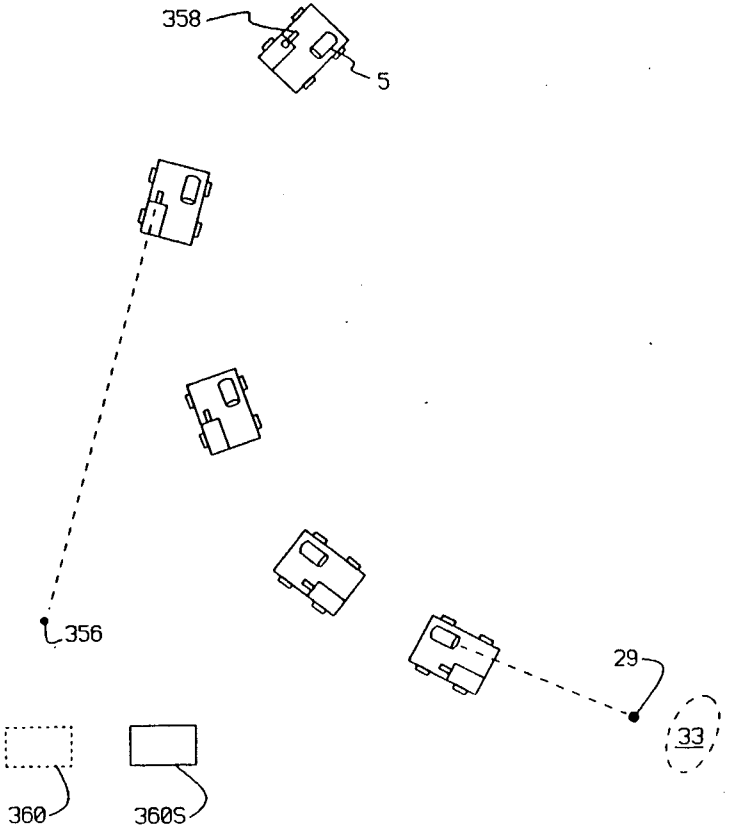
FIG. 30 illustrates a two-pronged attack by the invading vehicle: first, the golf ball 356 is fired; next, the PING-PONG ball 29 is fired.

18. There can be two or more goals which the defender must protect, and the invading vehicle can be equipped with a second type of weapon, such as a golf ball which he projects along the ground. For example, in FIG. 28A, the invading vehicle 3 carries a golf ball 356, which is propelled by a solenoid 358. The invading vehicle drives in as shown in FIG. 30 and launches the golf ball toward a target vehicle 360 when located at position A. The target vehicle is under the control of the defender, who must move it from position 360 to position 360S, in order to avoid being struck. In so doing, the defender is distracted, and, meanwhile, the invader 3 drives toward the usual goal 33 and fires a PING-PONG ball 29. The target vehicle can be wire-controlled.

The heavy ball can be fired by a spring-loaded machanism, or by a solenoid of the type which fires the PING-PONG ball. In addition, the speed of the vehicle is added to the speed given by the firing mechanism, so that the heavy ball runs ahead of the vehicle 3, at least initially.

Figure 29:
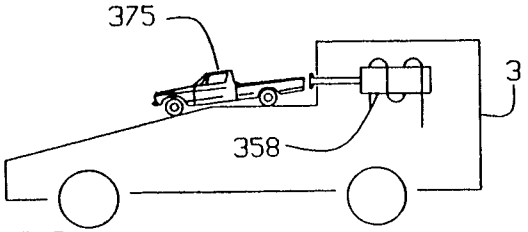
FIG. 29 illustrates a variant of FIG. 28, in which the invading vehicle carries a self-propelled attack vehicle which is launched against the defender.

A heavy ball is used because high inertia is required in order to roll the distance required to the target vehicle. However, a ball is not necessary. It is possible that a self-propelled vehicle 375 can be used instead, as shown in FIG. 29. The solenoid 375 activates the attacking vehicle, perhaps gives the attacking vehicle a small push, and the attaching vehicle drives off under its own power.

The attacking vehicle can be equipped with a mechanism which causes it to veer left and right, thus requiring the defender to constantly monitor it. With this motion, the defender cannot move his vehicle 360 to a given position and assume that it is safe. Preferably, the attacking vehicle travels much faster than the invading vehicle.

It is not necessary that the target for the attacking vehicle or the heavy ball be a vehicle. Instead, the target may be a large net, and the defender's vehicle acts to block the attacking vehicle/ball from the net, like a goalie in ice hockey. In this case, the defender actually tries to be struck by the attack vehicle.

A key point is that the invader launches a threat, perhaps as a mere feint, thereby forcing the defender to take action in response and partially abandon defense of another goal.

Figure 32:
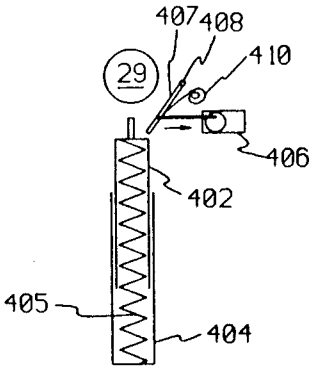
FIG. 32 illustrates a mechanism for remotely firing a PING-PONG ball.

19. An alternate method of shooting a PING-PONG ball is shown in FIG. 32. A sleeve 402 slides within another sleeve 404 and compresses a spring 405. A catch 407 rotates about pivot 408, and is biased against tube 402 by spring 410. A radio-controlled servo-mechanism 406, of the type identified above, pulls the catch to the right, and releases sleeve 402, which then strikes the ball 29.

20. An alternate type of play involves a non-controlled vehicle which senses a strike by a PING-PONG ball, and then (a) stops temporarily, (b) reverses for a distance and then drives forward, or (c) suffers some other penalty in response. In play, one player starts off the vehicle and aims it toward a goal line. The defending player then tries to stop the vehicle by throwing balls at it. If the vehicle reaches the goal, the invader wins.

As another alternate, the vehicle described in the preceding paragraph can be equipped with a PING-PONG ball cannon, which fires automatically at some time after the attacking player releases the vehicle. The time interval can be fixed, such as five seconds, or randomly determined. The object is for the vehicle to successfully get close enough to the goal line, without being struck by the defender, so that the ball flies over the goal. For example, if the ball flies three feet horizontally before it strikes the ground, then when the vehicle gets within three feet of the goal line, it will score. Thus, the defender must strike the vehicle before it reaches the three-foot mark.

When the defender strikes the vehicle, the cannon is either forced to make its usual shot, or a shot is forced, but at a lesser voltage, so that the cannon merely dumps the ball and the scoring drive fails. In the latter case, even after the invading vehicle passes the three-foot mark, a ball strike can spoil the shot, even though a goal would be scored if a shot were made. Either or both of (a) speed of the vehicle and (b) the time interval of cannon firing should be adjustable, so that the cannon fires as close as possible to the three-foot mark. In this way, a goal is likely, while the vehicle is kept away from the defender, who is shooting from behind the goal line.

In order to make it difficult for the defender to hit the invading vehicle, the vehicle can alternately veer left- and rightward, while following a constant centerline. A simple oscillatory motion in a steering mechanism can accomplish this veering. Generation of such motion is known in the art.

21. In the situation where mine-tagging is required, the defender may aim his stationary cannons at the locations where the mines are placed, because of the likelihood that the invading vehicle will be there at some time.

Numerous substitutions and modifications can be undertaken without departing from the true spirit and scope of the invention. What is desired to be secured by Letters Patent is the invention as defined in the following claims.

I claim:

1. A game, comprising:

a) a target;
b) a vehicle which
i) is remotely controllable by a player; and
ii) includes means for shooting a projectile toward the target;
c) sensing means on the vehicle for sensing one or more of the following events:
i) contact with a foreign object;
ii) proximity to a predetermined type of object;
iii) impingement of a predetermined type of radiation; and
d) penalty means for interfering with the player's control of the vehicle in response to the event.

2. A game, comprising:
a) a target;
b) an invading vehicle which is remotely controllable by a first player and includes means for shooting a projectile toward the target;
c) one or more roving vehicles which roam in the vicinity of the invading vehicle; and
d) one or more sensors on the invading vehicle for detecting contact with a roving vehicle.

3. A game according to claim 2 and further comprising:
e) penalty means, on the invading vehicle, which imposes a performance penalty in response to contact with a roving vehicle.

4. A game according to claim 3 and further comprising:
e) a self-propelled slug vehicle which advances toward a goal, and which stops in response to contact with the invading vehicle.

5. A game according to claim 3 and further comprising:
e) a self-propelled slug vehicle which advances toward a goal, and which temporarily reverses its advancement in response to contact with the invading vehicle.

6. A toy, comprising:
a) a vehicle which is remotely controllable by an operator;
b) a sensor on the vehicle for sensing a collision with a projectile; and
c) penalty means associated with the sensor for interfering with the operator's control of the vehicle in response to said collision.

7. A toy according to claim 6 and further comprising:
c) a cannon on the vehicle for shooting a projectile.

8. A game comprising:
a) an invading vehicle which is remotely controllable by a first player, and which includes:
i) a gun which shoots a projectile;
ii) a sensor for sensing a strike on the vehicle by a missile;
iii) a sensor for sensing a collision with another vehicle; and
iv) penalty means for responding to the sensors and temporarily interfering with control of the vehicle in response;
b) one or more targets for the gun;
c) one or more guns which are aimed by a second player and which shoot said missiles at the vehicle; and
d) a slug vehicle which advances toward a goal, and which suspends advancement in response to contact with the invading vehicle.

9. A toy, comprising:
a) a toy vehicle;
b) means for
i) receiving radiated signals from a remote operator and
ii) controlling movement of the vehicle in response to the received signals; and p1 c) a cannon on the vehicle which shoots a substantially hollow ball.

10. A toy according to claim 9 and further comprising:
c) a sensor on the vehicle for sensing a collision with an object; and
d) penalty means for interfering with the operator's control of the vehicle in response to a sensed collision.

11. A vehicle according to claim 9 and further comprising:
c) means for allowing the remote operator to fire the cannon.

12. A game, comprising:
a) a toy vehicle, which includes:
i) means for
A) receiving radiated signals from a remote operator and
B) controlling movement of the vehicle in response;
ii) a cannon which shoots a substantially hollow ball;
b) a plurality of bases which can be placed at selected locations by a player; and
c) means for interfering with control of the vehicle if the vehicle fails to periodically tag a base.

13. A game, comprising:
a) first and second self-propelled toy vehicles, the first being small enough that the second can roll over it;
b) a sensor on the second vehicle for sensing contact with the first vehicle;
c) means on the first vehicle for altering movement of the first vehicle in response to said contact.

14. An amusement system, comprising:
a) a first self-propelled vehicle;
b) a second self-propelled vehicle of height no greater than approximately the axle height of the first vehicle, and including:
i) means for sensing contact with the first vehicle and providing a contact signal in response.

15. A system according to claim 14 and further comprising:
c) a system on the second vehicle for responding to the contact signal and altering movement of the second vehicle in response.

16. A toy, comprising:
a) a miniature self-propelled vehicle;
b) a gun for shooting a projectile; and
c) a sensor for detecting contact with incoming missiles, and firing the gun in response.

17. Apparatus according to claim 16 and further comprising:
c) means for causing the gun to shoot following release of the vehicle by a player.

* * * * *